United States Patent [19]

Nieman

[11] 4,036,279

[45] July 19, 1977

[54] METHOD OF TREATING MOLTEN METAL IN CENTRIFUGAL CASTINGS

[75] Inventor: John R. Nieman, Pekin, Ill.

[73] Assignee: Caterpillar Tractor Co., Peoria, Ill.

[21] Appl. No.: 721,655

[22] Filed: Sept. 8, 1976

[51] Int. Cl.[2] ..... B22D 27/20; B22D 13/02

[52] U.S. Cl. ..... 164/57; 164/117; 164/157; 164/301

[58] Field of Search ..... 164/4, 57, 58, 114, 164/117, 157, 299, 301

[56] References Cited

U.S. PATENT DOCUMENTS

| | | | |
|---|---|---|---|
| 963,973 | 7/1910 | Wright | 164/57 |
| 1,469,206 | 10/1923 | Anthony | 164/114 X |
| 2,124,445 | 7/1938 | Carrington | 164/117 X |
| 2,152,717 | 4/1939 | Wehmeier et al. | 164/301 X |
| 3,056,179 | 10/1962 | Lorang | 164/301 X |
| 3,367,395 | 2/1968 | Karsay | 164/57 |
| 3,634,075 | 1/1972 | Hoff | 75/135 |
| 3,916,979 | 11/1975 | DeGois et al. | 164/57 |
| 3,991,808 | 11/1976 | Nieman et al. | 164/4 |

*Primary Examiner*—Ronald J. Shore
*Attorney, Agent, or Firm*—John W. Grant

[57] ABSTRACT

A pouring chute is positioned with its discharge end disposed within an elongated hollow casting mold which is rotatably supported on a plurality of rollers. A molten metal is poured from a ladle into a receiving end of the pouring chute while the casting mold is rotating. A treating agent in wire form is fed by a wire feed mechanism along a guide member positioned adjacent the pouring chute and into the stream of molten metal flowing through the pouring chute adjacent the discharge end thereof for meltably intermixing with the molten metal. The wire feed mechanism and hence the feed rate of the wire is controlled in direct proportion to the flow rate of the molten metal through the pouring chute.

5 Claims, 1 Drawing Figure

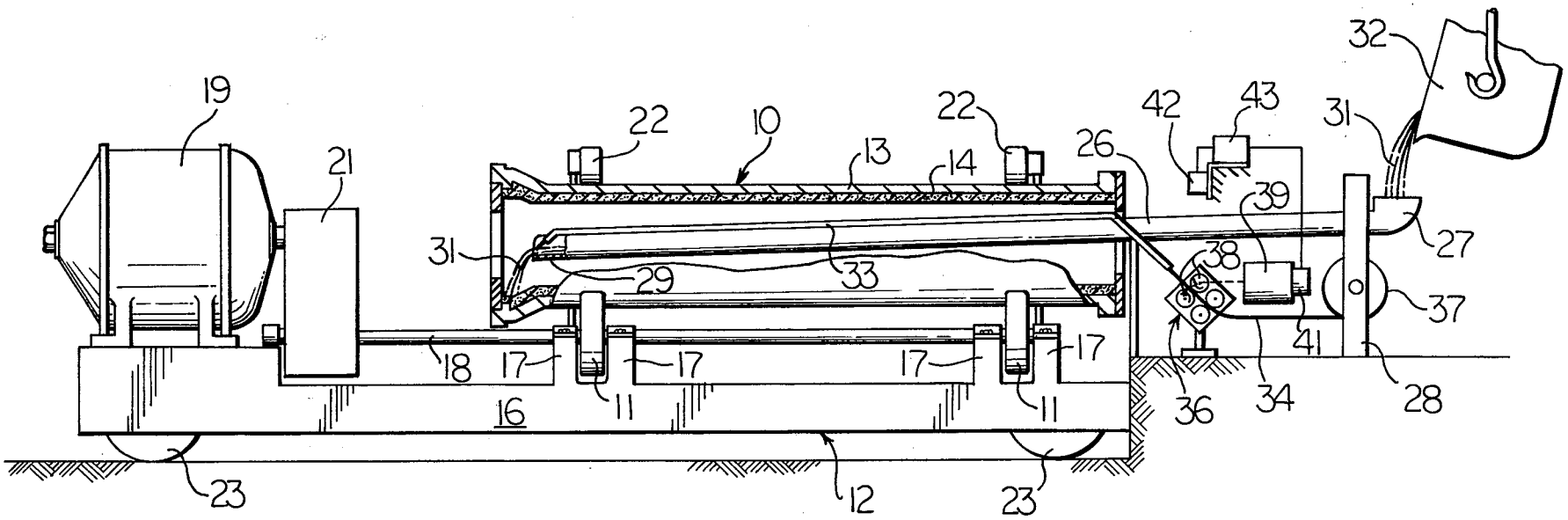
32
31
27
37
28
41
34
43
39
38
36
42
26
17
11
23
22
14
13
33
12
10
29
16
18
21
19

METHOD OF TREATING MOLTEN METAL IN CENTRIFUGAL CASTINGS

BACKGROUND OF THE INVENTION

This invention relates to metal founding and more particularly to centrifugal casting in which the molten material is impelled radially outwardly against the forming surface by rotation of the surface.

Many cylindrical parts such as cast iron pipes, tubular casting, bearings, and the like, are manufactured by utilizing the casting process known as centrifugal casting. Although this basic process has proven highly effective for mass production of cylindrical parts, one of the difficulties encountered therewith has been that of controlling the microstructure of the casting particularly when the casting is made of cast iron. The physical properties and microstructure of cast iron are controlled by adding a variety of treatment materials to the molten base metal.

One method of adding treatment materials to molten iron is by the batch process where a measured amount of a treatment agent is thrown into the molten iron within the ladle prior to pouring the molten iron into the mold. However, the effect of treatment agents is time dependent and tends to fade immediately after mixing with the molten iron. Thus, even if a slight delay in the pouring process occurs, the effect of treatment agents is lost and the resulting casting will not have the proper microstructure.

Another method of adding the treating agent to the molten iron consists of feeding a treatment agent in powder form from a hopper into a stream of molten iron flowing through a pouring channel and into a mold. However, one of the problems associated with treating agents in bulk or powdered form is that they tend to pick up moisture both in storage and in use. If the treating agent is not kept dry the moisture tends to create pin holes in the resulting cavity. Also, the environment in which the powdered treating agent is kept tends to promote caking of the treating agent in the hopper, making accurate metering of the treating agent from the hopper difficult to control. Also, uneven distribution causes partial or incomplete dissolution such that inclusions remaining are detrimental to the quality of the completed product.

OBJECTS OF THE INVENTION

Accordingly, an object of this invention is to provide an improved method of centrifugally forming iron castings where the microstructure of the casting is controlled by the addition of treatment agents to the molten iron being poured into a rotating casting mold.

Another object of this invention is to provide such an improved method of centrifugally forming ductile iron castings which utilizes a wire feed process for adding a nodulizing agent in wire form to the molten base iron being poured into the rotating casting mold.

Other objects and advantages of this invention will become more readily apparent upon reference to the accompanying drawing and following description.

BRIEF DESCRIPTION OF THE DRAWING

The sole figure is a schematic representation of one form of apparatus for treating molten metal in centifugal castings.

DESCRIPTION

One apparatus for accomplishing the method of the present invention is illustrated in the drawing and includes a wire feed apparatus for feeding a treating agent in wire form through a guide tube disposed adjacent to a pouring chute protruding inside a hollow rotating casting mold so that as the wire exits the guide tube, it is fed into and meltably mixes with a stream of molten base metal flowing from the discharge end of the pouring chute and into the casting mold.

In one example, the molten base metal is molten cast iron and the treating agent is magnesium or a magnesium alloy added at a predetermined rate in relation to the pouring rate of the molten cast iron so as to produce a ductile iron casting.

Referring now to the drawing, the apparatus includes an elongated hollow cylindrical casting mold 10 rotatably supported by a plurality of rollers 11 of a trunnion type horizontal centrifugal casting machine 12. The casting mold shown in the drawing includes an outer metal flask 13 and an inner sand core lining 14. Alternatively, the casting mold may be a liquid cooled casting mold which has inner and outer cylindrical sleeves separated by annular space through which a liquid such as water is circulated for cooling the inner sleeve.

The centrifugal casting machine 12 includes a base 16 having a plurality of upwardly extending bearing blocks 17 for rotatably supporting the rollers 11. A drive shaft 18 is drivingly connected to the rollers and is driven by an electric motor 19 through a pulley and drive belt arrangement 21. A pair of top rollers 22 are suitably mounted to the base in the usual manner to rollably engage the flask 13 for maintaining the casting mold against the supporting rollers. Thus, energizing the electric motor causes the casting mold to rotate at a predetermined speed sufficient for the centrifugal force generated by rotation forces the molten metal poured thereinto under constant pressure against the interior surface of the casting mold. The base is mounted on a plurality of wheels 23 to provide mobility to the casting machine in the direction of the longitudinal axis of the casting mold.

An elongated pouring chute 26 is positioned with a molten iron receiving end portion 27 supported by a stationary frame 28 and a discharge end 29 extending into the hollow casting mold. Preferably, the chute is sloped so that the discharge end is lower than the receiving end to facilitate the flow of molten iron therethrough toward the discharge end. The receiving end is appropriately shaped for receiving a flow of molten base iron 31 which is poured from a ladle 32 at a controlled predetermined pouring rate.

A guide member or tube 33 is positioned adjacent the pouring chute 26 and is secured to the upper portion of the pouring chute with its inwardly disposed end angled downwardly towards the stream of molten base iron 31 flowing from the discharge end of the pouring chute. The opposite end of the guide tube is positioned to receive a treating agent in the form of a wire 34 selectively fed thereinto by a wire feed mechanism 36. A supply of the wire is carried on a spool or reel 37 is rotatably mounted on the frame 28. The wire feed mechanism includes a plurality of rollers 38, at least one of which is driven by an electric motor 39 in any suitable manner such as a direct drive or through a gear reduction train. A speed control 41 is mounted on and operatively connected to the motor for selectively manually varying the speed thereof and hence the feed rate of the wire through the tube. The wire may be of any suitable type having the ability to meltably intermix with the molten metal. One type of wire is disclosed in the U.S. Pat. No. 3,921,700 issued on Nov. 25, 1975 to J. G. Frantzreb, Sr., et al. and assigned to the assignee of the present application. That wire has a core of treating agent in granular form encapsulated within an insulating sheath. The amount of treating agent per inch of that wire is precisely controlled and the thickness of the insulating sheath is selected so that it is readily melted shortly after penetrating the stream of molten iron. The sheath protects the treating agent from moisture in the air both in storage and in use.

An electronic sensing device 42 such as an electric eye or an infared sensor which is activated by the presence of the molten iron in the pouring chute is positioned above the pouring chete and is connected to an electronic timer 43. The timer is, in turn, connected to the speed control 41 mounted on th electric motor 39 and is operative for automatically starting and stopping the electric motor. The electronic sensing device, electronic timer and electric motor 39 are suitably connected to a source of electric power in the usual manner.

OPERATION

While the operation of the present invention is believed clearly apparent from the foregoing description, further amplification will subsequently be made in the following brief summary of such operation. Immediately prior to starting the pour, the temperature of the molten base iron in the ladle 32 is measured by any suitable known temperature measuring apparatus. With the temperature of the iron known and since the iron is to be poured from the ladle at a predetermined pour rate, the speed control 41 is manually adjusted to provide a wire feed rate for adding a predetermined controlled amount of treating agent to the molten iron for that temperature and pouring rate. Of course, it is to be understood that the wire feed rates for various combinations of pouring rates and temperatures have been previously determined either experimentally or through calculations.

With the casting machine 12 initially in the position shown, the electric motor 19 is energized to rotate the casting mold 10 at the predetermined speed. The ladle 32 is then tipped to pour molten base iron into the receiving end 27 of the pouring chute 26 at the controlled pouring rate. As the molten iron flows through the pouring chute, the electronic sensing device 42 is activated when the leading edge of the stream of molten iron passes a predetermined point thereunder and actuates the electronic timer 43. A delay is preset into the timer to start the electric motor 39 of the wire feed mechanism 36 a predetermined time after the timer is started. The predetermined time is about the time required for the leading edge to travel between the predetermined point and the discharge end of the pouring chute and is determined by timing the flow of molten metal between those two points. It is to be assumed that the wire has been prefed into the guide tube with the end of the wire protruding slightly beyond the inner end of the tube. Such a condition normally automatically occurs when the wire feed mechanism is stopped at the end of each pour. After the amount of time delay set into the timer has passed, the timer automatically activates the electric motor through the speed control 41 thereby feeding the wire 34 through the guide tube 33 so the end of the wire is fed into the stream of molten iron as it is discharged from the discharge end of the pouring chute. The wire is continuously melted a predetermined distance below the surface of the molten iron where the ingredients of the wire are meltably intermixed with the molten iron as it flows into the casting mold. The wire is fed into the stream and continuously at the fixed feed rate determined by the speed control so long as the molten iron is flowing through the pouring chute to uniformly treat all the molten iron.

After an initial amount of molten iron and treating agent mixture is poured into the casting mold 11, the casting machine 12 is moved to the left in the usual manner so that th casting mold is translated along its longitudinal axis and the treated molten iron is deposited in a helical path within the casting mold. After the desired amount of iron has been poured into the casting mold and the flow of iron through the pouring chute and the wire feed mechanism have been stopped, rotation of the casting mold will continue until the iron has solidified sufficiently to remain in a permanent shape.

The invention in its broader aspects is not limited to the specific steps and embodiments herein shown and described, but departures may be made therefrom without departing from the principles of the invention and without sacrificing its chief advantages.

I claim:

1. A method of centrifugal treating molten metal in casting comprising the steps of:

supporting an elongated hollow casting mold on a plurality of rollers with its longitudinal axis disposed substantially horizontal;

positioning a pouring chute with its discharge end disposed within the hollow casting mold and its receiving end outside of the hollow casting mold, the discharge end being lower than the receiving end;

positioning a guide member adjacent the pouring chute with one of its ends being adjacent the discharge end of the pouring chute;

rotating the casting mold by powerably driving at least one of the rollers;

pouring a molten base metal from a ladle into the receiving end of the pouring chute so that the molten base metal flows in a stream through the pouring chute and from the discharge end into the rotating casting mold;

feeding a treating agent in wire form from a wire feed mechanism along the guide member and into the stream of molten base metal adjacent the discharge end of the pouring chute for meltably intermixing therewith; and controlling the wire feed mechanism and hence the feed rate of the wire in direct proportion to the flow rate of the molten base metal through the pouring chute.

2. The method of claim 1 including the steps of moving the casting mold along its longitudinal axis simultaneously with the pouring of the molten metal the rotating casting mold.

3. The method of claim 1 including the steps of presetting a delay into a timer to start the wire feed mechanism a predetermined time after the timer is actuated, and actuating the timer when the leading edge of the molten metal passes a predetermined point in the pouring chute upon initial pouring of the molten metal thereinto.

4. The method of claim 3 wherein the step of actuating the timer includes the initial steps of determining said predetermined time by timing the flow of molten metal from the predetermined point to the discharge end of the pouring chute, and positioning an electronic sensing device to start the timer therewith when the leading edge of the molten metal passes said predetermined point.

5. A method of centrifugally forming a ductile iron casting comprising the steps of:

supporting an elongated hollow casting mold for both rotation about a longitudinal axis and for translation along said axis;

positioning the casting mold so that a pouring chute has its discharge end extending thereinto and its receiving end disposed outside thereof and the discharge end at a level lower than the receiving end;

positioning a guide member adjacent the pouring chute with one of its ends adjacent the discharge end of the pouring chute;

rotating the casting mold;

pouring a molten base iron from a ladle into the receiving end of the pouring chute so that the molten base iron flows in a stream through the pouring chute and from the discharge end into the rotating casting mold;

feeding a wire containing at least one part of magnesium from a wire feed mechanism along the guide member and into the stream of molten base iron adjacent the discharge end of the pouring chute for meltably intermixing therewith;

translating the casting mold along the longitudinal axis simultaneously with the pouring of the molten iron into the rotating casting mold;

controlling the wire feed mechanism and hence the feed rate of the wire in direct proportion to the flow rate of the molten base iron through the pouring chute.

* * * * *